United States Patent [19]

Berger

[11] Patent Number: 5,056,668

[45] Date of Patent: Oct. 15, 1991

[54] DISPLAY TRAY

[75] Inventor: Barry D. Berger, New York, N.Y.

[73] Assignee: R.N. Koch, Inc., Providence, R.I.

[21] Appl. No.: 600,495

[22] Filed: Oct. 19, 1990

[51] Int. Cl.[5] ..... A47F 7/00

[52] U.S. Cl. ..... 211/13; 211/87; 248/902

[58] Field of Search ..... 211/13, 87; 248/902, 248/309.1, 316.8

[56] References Cited

U.S. PATENT DOCUMENTS

| | | | |
|---|---|---|---|
| D. 161,850 | 2/1951 | Maier | 248/902 X |
| 993,404 | 5/1911 | Price | 248/902 X |
| 2,623,722 | 12/1952 | Glunt | 248/902 X |
| 4,903,925 | 2/1990 | Park | 248/902 X |

*Primary Examiner*—Robert W. Gibson, Jr.
*Attorney, Agent, or Firm*—Salter & Michaelson

[57] ABSTRACT

Tray for displaying one or more folded eyeglasses, including spaced vertical walls joined by an inclined support post.

9 Claims, 1 Drawing Sheet

DISPLAY TRAY

BACKGROUND OF THE INVENTION

In the retail sale of expensive articles, it is usually important that each article be displayed in such a way that it appears attractive. This is particularly true in the case of eyeglasses, whether they be corrective glasses or sunglasses, since there are a large number of styles to put on display at the same time. Despite the large number of frames or complete glasses, it is still important that the prospective buyer be able to examine each item from all sides and, by displaying the merchandise properly, he or she may be able to do so without handling the item. The handling of a pair of sunglasses can cause it to be smeared with finger prints and these not only show on the surface of the glasses, but they also collect dust. When dozen of styles are on display, the attempt to keep them clean and attractive presents a real problem.

The method of displaying sunglasses and the like in the past has usually consisted of placing them on recessed shelves or in clips on a board. In either case, the merchandise cannot be easily examined without handling it, thus leading to breakage, soiling, and lack of aesthetic appeal. These and other difficulties experienced with the prior art devices have been obviated in a novel manner by the present invention.

It is, therefore, a primary object of the present invention to provide a display tray for eyeglass items which allows visual access to almost all sides of the item.

Another object of this invention is the provision of a device for displaying merchandise, such as a pair of sunglasses, in such way as to take full advantage of its attractiveness.

A further object of the instant invention is the provision of a tray for the exhibition of a plurality of eyeglasses in such a manner that each one is clearly visible.

It is another object of the instant invention to provide a display tray for a pair of eyeglasses which allows complete inspection without the necessity of handling it.

A still further object of the invention is the provision of a display tray which, when used with other similar trays, permits the exhibition of a large number of eyeglasses with a minimum of spoilage or soiling due to handling.

It is a further object of the invention to provide a display tray which is simple, light-weight, and rugged in construction, which is inexpensive to manufacture from readily-available materials, and which is capable of a long life of useful service with a minimum of maintenance.

With these and other objects in view, as will be apparent to those skilled in the art, the invention resides in the combination of parts set forth in the specification and covered by the claims appended hereto.

SUMMARY OF THE INVENTION

In general, the invention has to do with a display tray for exhibiting sunglasses, each pair of which has a nose piece and bows. The tray has a main body formed with a horizontal floor from which rise at least two spaced, vertical walls. A support post, having an upper surface that is formed to receive a nose piece, extends from one wall to the other at a substantial angle to the floor.

Preferably, the main body includes a second floor located at a lower level than the first floor and a third wall extends upwardly from the second floor and spaced from and parallel to the said other wall. A second support post extends angularly between the third wall and said other wall. The said one wall is provided with hook-like connectors to facilitate mounting on a panel having slots to receive the connectors. The tray is integrally formed of a clear polymer.

BRIEF DESCRIPTION OF THE DRAWINGS

The character of the invention, however, may be best understood by reference to one of its structural forms, as illustrated by the accompanying drawings, in which.

DESCRIPTION OF THE PREFERRED EMBODIMENT

Figure 1:
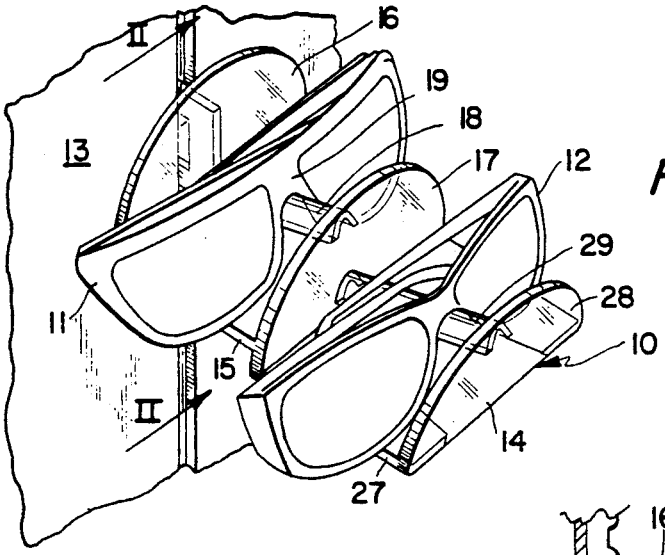
FIG. 1 is a perspective view of a display tray incorporating the principles of the present invention and shown in use with two eyeglasses.

Referring first to FIG. 1, which best shows the general features of the invention, the display tray, indicated generally by the reference numeral 10, is shown in use with two pairs of folded sunglasses 11 and 12. The tray is mounted on a wall 13 forming part of a panel or cabinet in a retail merchandising establishment.

Figure 2:
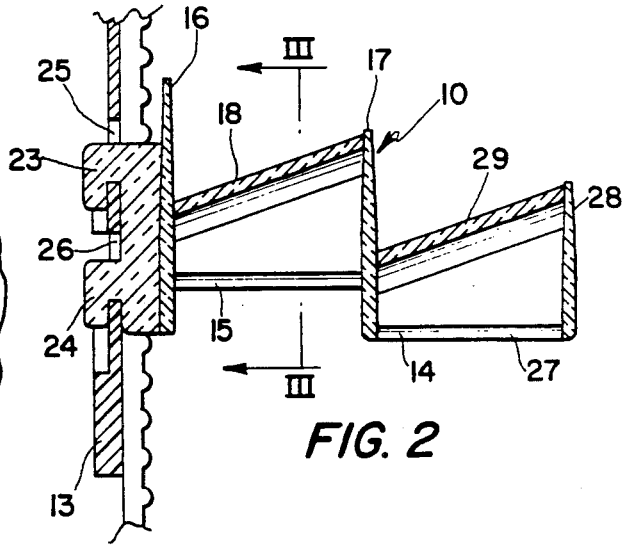
FIG. 2 is a vertical sectional view of the display tray, taken on the line II—II of FIG. 1.

As shown in FIG. 2, the tray 10 has a main body 14 that is formed with a horizontal floor 15 from which rises a first vertical wall 16 and from which also rises a second vertical wall 17 which is parallel to and spaced from the first wall. A support post 18, which is shaped to receive the nose piece 19 of the sunglasses 11, is fixed at its ends to the facing surfaces of the walls 16 and 17. The post is connected to the second wall 17 at a point that is considerably higher than the point at which it is attached to the first wall 16, thus sloping downwardly from the front to the back.

FIG. 2 shows the manner in which the rear wall 16 is provided with an attachment means consisting of two vertically-spaced hooks 23 and 24 which engage and lock to two vertical slots 25 and 26, respectively, formed in the wall or panel 13.

Figure 3:
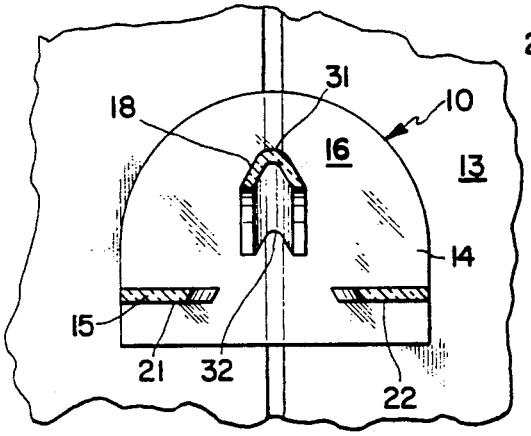
FIG. 3 is a vertical sectional view of the display tray, taken on the line III—III of FIG. 2.
Figure 5:
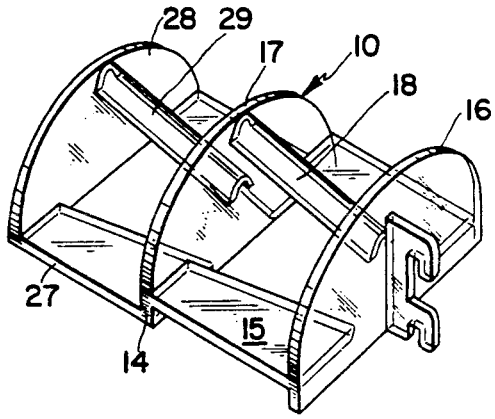
FIG. 5 is a perspective view of the tray as viewed from the rear.
Figure 4:
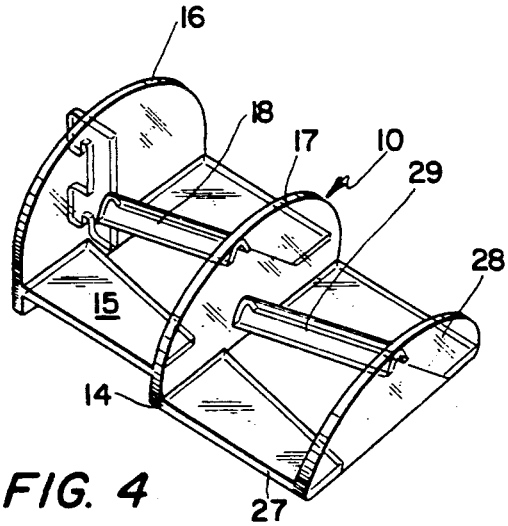
FIG. 4 is a persepctive view of the display tray without the glasses and as viewed from the front.

FIG. 3 illustrates particularly well the manner in which the floor 15 is divided into two spaced portions 21 and 22. FIG. 3 also shows that the main body 14 includes a second floor 27 located at a substantially lower level than the first-mentioned floor 15. A third vertical wall 28 extends upwardly from the forward end of the floor 27 and, of course, is spaced from and parallel to the second wall 17. A second support post 29 extends angularly between this third wall and the second wall.

In the preferred embodiment, the parts of the display tray 10, including the floors 15 and 27, the walls 16, 17, and 28, the support posts 18 and 29, and the hooks 23 and 24, are integrally formed by injection molding of clear polymer.

FIG. 3 shows the special cross-sectional shape of the support post 18, including its upper curved convex surface 31 and its lower concave surface 32. The outer post 29 is similarly constructed and slopes in the same direction and at the same angle. The posts, therefore, act not only as supports for the eyeglasses, but also as effective braces between the walls.

Each of the floors 15 and 27 are formed in two spaced parts to lighten the structure and to leave a central space to encourage light passage and air flow around the merchandise. The three walls 16, 17, and 28 are of generally the same shape, preferably, a rounded semi-circular configuration; and as will be seen most clearly in FIG. 2, forwardmost wall 28 has a height somewhat less than that of wall 17, which in turn is of lesser height than wall 16. By making walls 17 and 16 progressively higher, ample wall surface is provided to support the bows of the glasses leaning thereagainst, and also permits the rear support post 18 to be higher than front support post 29.

The operation and advantages of the invention will now be readily understood in view of the above description. The tray 10 is first attached to the wall 13 by inserting the flat hooks 23 and 24 through the slots 25 and 26, respectively, and then moving them downwardly to lock them in place. In FIG. 2 it is evident that the rear wall 16 is spaced somewhat from the panel 13 in order to promote light and air passage. In some situation, however, it may be desirable to have the rear wall pressed against the surface of the panel. The eyeglasses 11 and 12 are then placed in the tray with their nose pieces straddling the support posts 18 and 29, respectively. The bows rest in the corner formed by the intersection of the posts with the forward surface of their respective rearward walls 16 and 17. As a matter of fact, each eyeglasses slides down its support post until it rests snugly against its rearward wall.

It can be seen, then, that the present invention performs its function as a rigid, strong, cantilevered support that is, nevertheless, light in weight. Because of its construction, it allows light to reach all parts of the merchandise. In addition, the free flow of air around the sunglasses, etc., tends to promote cleanliness, thus preserving the asethetic beauty of the merchandise without frequent washing. It becomes possible to display a large number of eyeglasses, frames, and sunglasses in a limited area withouth preventing each item from being closely inspected by a customer. The angular inclination of the support posts 18, and 29 causes the glasses to tilt upwardly slightly, for more convenient viewing by a prospective customer. If the posts were not downwardly inclined from front to rear, glasses mounted thereon would tilt downwardly and hence would not be as directly exposed to a customer standing in front of the display. Also, as seen most clearly in FIG. 1, the fact that the forwardmost floor 27 is at a lower level than rear floor 15 causes the glasses to be displayed in stepped relation, so that the front glasses 12 do not obscure the glasses 11 mounted therebehind. Since the glasses are so clearly displayed and visible, there is less of a tendency for prospective customers to handle the merchandise, which in turn extends shelf life (due to less breakage), and it is necessary to clean the merchandise less often.

It is obvious that minor changes may be made in the form and construction of the invention without departing from the material spirit thereof. It is not, therefore, desired to confine the invention to the exact form herein shown and described, but it is desired to include all such as properly come within the scope claimed. For example, the tray 10 could comprise only one support post extending between two vertical walls, or in the alternative, there coule be three or more support posts with the floor beneath each post being stepped upwardly, from front to rear.

The invention having been thus described, what is claimed as new and desired to secure by Letters Patent is:

1. Display tray for an eyeglass, comprising:

(a) a main body having a horizontal floor and two spaced, substantially parallel, vertical walls extending upwardly therefrom, (b) a support post for the nose piece of the eyeglass extending between the walls at a substantial angle to the floor, (c) one of said walls being provided with means for attachment to a vertical supporting surface, and (d) said support post extending from an attachment location on the other wall that is higher than the attachment position on the said one of the walls, so that the eyeglass rests with its nose piece on the support post and its bows leaning against the said one of the walls.

2. Display tray as recited in claim 1, wherein the main body includes a second floor located at a lower level than the first-mentioned floor and includes a third vertical wall extending upwardly from the second floor at a location which is parallel to and spaced from the said other wall, and wherein a second support post extends angularly between the third wall and the said other wall.

3. Display tray as recited in claim 2, wherein the said means for attachment consists of two vertically-spaced hooks adapted to engage and lock to a vertical panel having two vertically-spaced slots.

4. Display tray as recited in claim 3, wherein the floors, walls, hooks and support posts are formed of a clear polymer.

5. Display tray as recited in claim 2, wherein each support post is elongated, and is provided with an upper curved convex surface and a lower concave surface, which surfaces extend the entire length of the post.

6. Display tray as recited in claim 2, wherein each of the said floors consists of two spaced, parallel platforms.

7. Display tray as recited in claim 2, wherein each of the three walls is of generally semi-circular configuration and of smaller size from front to rear, so that the support post at the rear is higher than the support post at the front.

8. Display tray for an eyeglass, comprising:

(a) a main body having a horizontal floor from which extends a first, a second, and a third vertical wall, the walls being spaced and parallel to each other, (b) a hook-type attaching means extending from the first wall in the direction away from the other walls, (c) a first support post extending from a high point on the second wall to a relatively low point on the first wall, and (d) a second support post extending from a high point on the third wall to a relatively low point on the second wall.

9. Display tray as recited in claim 2, wherein the horizontal floor consists of a first portion joining the first and second walls, and a second portion joining the second and third walls, and wherein the second portion is located at a substantially lower level than the first portion.

* * * * *